US011536532B1

(12) United States Patent
Grace et al.

(10) Patent No.: US 11,536,532 B1
(45) Date of Patent: Dec. 27, 2022

(54) ARCHERY BOW CAM SPACER

(71) Applicant: Grace Engineering Corp., Memphis, MI (US)

(72) Inventors: Nathaniel E. Grace, Fort Gratiot, MI (US); Scott C. Prater, Shelby Township, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 17/489,147

(22) Filed: Sep. 29, 2021

(51) Int. Cl.
*F41B 5/10* (2006.01)
*F41B 5/14* (2006.01)

(52) U.S. Cl.
CPC ..... *F41B 5/105* (2013.01); *F41B 5/1403* (2013.01)

(58) Field of Classification Search
CPC ..... F41B 5/10; F41B 5/105
See application file for complete search history.

(56) References Cited

U.S. PATENT DOCUMENTS 4,064,862 A * 12/1977 Groner ..... F41B 5/105 124/900
4,333,443 A * 6/1982 Roelle ..... F41B 5/10 124/90
5,390,655 A * 2/1995 Mitchell ..... F41B 5/105 124/90
6,415,780 B1 * 7/2002 Proctor ..... F41B 5/10 124/900
6,474,324 B1 * 11/2002 Despart ..... F41B 5/105 124/25.6
8,950,388 B2 * 2/2015 McPherson ..... F41B 5/14 124/88
9,115,953 B1 * 8/2015 Huang ..... F41B 5/105
9,528,788 B2 * 12/2016 McPherson ..... F41B 5/10
10,126,087 B1 * 11/2018 Grace ..... F41B 5/123

OTHER PUBLICATIONS https://www.archerytalk.com/threads/e-clip.5329861/, downloaded Sep. 24, 2021.

* cited by examiner

*Primary Examiner* — John A Ricci
(74) *Attorney, Agent, or Firm* — Warner Norcross + Judd LLP

(57) ABSTRACT

An archery bow assembly is provided including an open sided spacer which is mountable to an axle on an archery bow and removable therefrom without removing the axle entirely or partially from a limb of the archery bow. The spacer can mount on the axle adjacent a cam rotatable on the axle, and can include an outer perimeter and an axle aperture. A recess can extend inward from the outer perimeter to the axle aperture so that the axle aperture and recess form a continuous opening. The spacer can be of a C-shape or E-shape so that it can be frictionally pressed onto the axle and removed therefrom without removing the axle from the limb arms adjacent the cam. Related methods also are provided.

20 Claims, 8 Drawing Sheets

ARCHERY BOW CAM SPACER

BACKGROUND OF THE INVENTION

The present invention relates to archery products, and more particularly to a spacer to precisely position a cam on an axle of an archery bow.

Conventional compound and crossbow archery bows include a bowstring and a set of power cables that transfer energy from the limbs and cams, eccentrics or pulleys (which are all referred to generally as "cams" herein) of the bow to the bowstring, and thus to an arrow shot from the bow. The function of the cams is to provide a mechanical advantage so that energy imparted to the arrow is a multiple of that required of an archer to draw the bow. The cams typically are rotatably mounted to limbs via respective axles.

In most bows, a cam is rotatably mounted in a recess between free ends of a solid limb, or between two opposing limb arms of a split limb. An axle projects through the cam, and any associated bearings of the cam, as well as the free ends of the solid limb, or the opposing arms of a split limb. Sometimes, cylindrical bushings or circular washers are placed between the cam and the free ends or opposing arms of the limb to properly space or center the cam between those elements. To install these cylindrical bushings or circular washers, the axle must be removed from the limb, out from the limb recess, and then carefully redirected back into the limb recess, projecting through the center bore or hole of the cylindrical bushings or circular washers such that those elements are trapped on the axle.

While conventional cylindrical bushings or circular washers can position the cam between the free ends or opposing arms of a limb, they are tedious to install, and require full or partial removal of the axle from the limb and limb recess. Frequently, this requires that the bow be placed in a bow press to reduce the energy stored in the limbs so that the bow is safe to work on. This takes time and, of course, special equipment like a bow press. The components of the assembly, that is, the cam, the cylindrical bushings and/or the circular washers also have to be sequentially placed on the axle to ensure that the stack is appropriate along the axle, and achieves the desired placement of the cam along the axle. If the placement of a bushing or washer is improper, a user will remove the entire axle again to correct the misplacement. This can be tedious and time consuming. Likewise, if a bushing or washer of the wrong thickness is erroneously placed on the axle adjacent the cam, to replace that element with a correct or a better one, a user will remove the axle partially or fully from the limb.

Further, if a particular cylindrical bushing or circular washer is not of an appropriate thickness to provide a particular placement of the cam along the axle, an unwanted gap adjacent the cam or limb part can develop. As a result, the cam and components can slide laterally along the axle, which can lead to inconsistent and/or imprecise rotation of the cams. To replace the element, again, a user will use a bow press and remove the axle.

Accordingly, there remains room for improvement in the field of archery bows, and in particular, axle systems for rotating cams.

SUMMARY OF THE INVENTION

An archery bow assembly is provided including an open sided spacer which is mountable to an axle of an archery bow and removable therefrom without removing the axle from a limb of the archery bow.

In one embodiment, the spacer can mount on the axle adjacent a cam also mounted on the axle and rotatable thereto. The spacer can include an outer perimeter and an axle aperture. A recess can extend inward from the outer perimeter to the axle aperture so that the axle aperture and recess form a continuous opening.

In another embodiment, the open sided spacer can be of a C-shape or E-shape so that it can be frictionally pressed onto the axle and removed therefrom. The recess can have a recess width that is less than a diameter of the axle. The axle aperture can have a width that is equal to or greater than the diameter of the axle.

In still another embodiment, the spacer can be mounted to the axle by orienting the recess transverse to the axle. The spacer can be advanced toward a longitudinal axis of the axle in a direction that is transverse to the axis. The spacer can in some cases move radially inward toward the longitudinal axis.

In yet another embodiment, the spacer can be mounted on the axle and under compression between a limb arm and a cam or compression bearing. The spacer, cam and bearing can be clamped against one another, with zero gaps therebetween. Even under this compression, the cam can freely rotate relative to the axle between the limb parts and adjacent the open sided spacer mounted to the axle.

In even another embodiment, the spacer can include a friction feature in the recess that allows the spacer to be pressed on and off the axle, transverse to the longitudinal axis of the axle. In so doing, the axle passes through the recess and into the axle aperture where it settles. The axle thus can pass into and through a portion of the continuous opening in this installation.

In a further embodiment, the open sided spacer can be provided in a set, with different spacers in the set having different thicknesses. One spacer can be installed on one side of a cam, and another spacer on the other side of the cam. The spacers can be selected depending on their thicknesses to shift the cam, left and/or right along the axle, to adjust the center shot and/or tune of the bow.

In still a further embodiment, the set of different spacers can have multiple thicknesses that can be mixed and matched along the axle to properly position the cam along the axle. As one example, the set can include one or more first spacers having a first thickness of 0.100 inches, one or more second spacers having a second thickness of 0.130 inches, and one or more third spacers having a third thickness of 0.160 inches. Of course, the thicknesses can vary depending on the cam, the limb recess in which the cam rotates, and other factors.

In yet a further embodiment, the cam can include a bearing having an inner bearing portion and an outer bearing portion. The open sided spacer can be placed on the axle in contact with the inner bearing portion. The axle and/or a fastener joined with the axle can be operable in a compression mode to exert a compression force, such as an axial clamping force, against the spacer which engages the bearing inner portion so the bearing inner portion is non-rotatable relative to the axle, while the outer portion remains uncompressed and rotatable relative to the axle, along with the cam.

In yet a further embodiment, the compression force is an axial clamp force optionally of at least 1 pound, further optionally between 1 pound and 500 pounds.

In another embodiment, a method of using an archery bow assembly is provided. The method can include providing a bow with the above components, for example, providing an axle installed in opposing limb arms, with a cam rotatably mounted on the axle, and pressing an open sided spacer onto the axle in a direction transverse to the longitudinal axis of the axle until the axle enters an axle aperture of the spacer, without removing the axle from the limb.

In still another embodiment, the method can include loosening an axle compression fastener associated with the axle; sliding the axle through a recess of the spacer such that the recess expands in width until the axle enters the axle aperture.

In yet another embodiment, the method can include selecting different thickness open sided spacers; selectively placing a first spacer adjacent one side of the cam without removing the axle; selectively placing another spacer adjacent an opposite side of the cam; and tightening a fastener to exert a compression force on the first spacer, cam and the second spacer. The first and second spacers can have the same or different thicknesses depending on the positioning of the cam relative to the limb.

In even another embodiment, the method can include placing a spacer adjacent a bearing inner portion that is included in a bearing also having a bearing outer portion joined with a cam, exerting a compression force on the spacer between the bearing inner portion and a part of a limb, removing the compression force, and pushing the spacer off an axle while the axle remains mounted to the limb part. Optionally, the axle exits an opening of the spacer through an outer perimeter of the spacer, rather than through the axle aperture in which the axle is disposed in use on the bow.

The open sided spacer and archery bow of the current embodiments can provide an axle assembly that is easy to service and to adjust the centershot and/or tune of the bow. One or more spacers can be installed on and removed from the axle without removing the axle from an associated limb. This can reduce or eliminate the use of a bow press when adjusting or tuning the bow at the cams. In some cases, different spacers can come in a set of different thicknesses, and selected ones of the spacers can be quickly and easily mounted to the axle adjacent the cam to address cam lean, or to tune the bow.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and are being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
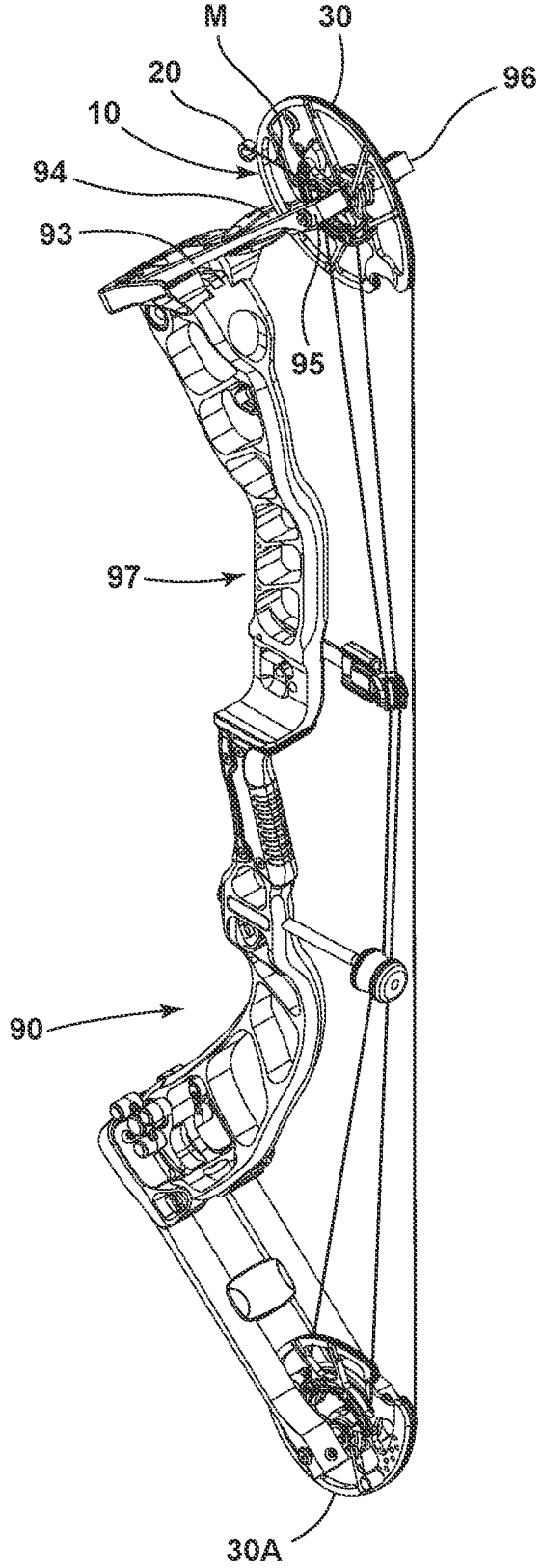
FIG. 1 is a perspective view of an archery bow including an open sided spacer and axle assembly of a current embodiment.

A compound archery bow including one or more cams and an archery bow assembly in accordance with a current embodiment is illustrated in FIGS. 1-7 and generally designated 10. The bow 90 can include a cam 30, which optionally is part of a dual cam system on the bow 90. The cam 30 can include one or more tracks 31, 32, which can be bowstring tracks, a power cable track or other tracks suitable to receive and guide elongated elements such as bowstrings and power cables.

The cam 30 can be mounted to a limb 93, which can be joined with the riser 97 of the bow. The exemplary cam 30 illustrated can be an upper cam, and the bow 90 can include another lower cam 30A spaced apart from the upper cam 30 and of a similar configuration. The limb 93 can be in the form of a split limb, including a first arm, first sub limb or limb portion 95 and a second arm, second sub limb or limb portion 96 that are separated from one another along respective lengths of each of the first sub limb and the second sub limb. Although shown in connection with a split limb, the current embodiments are well suited for solid limbs having limb portions separated somewhere along their length to accommodate a rotating body, as well as limbs having axle systems mounted to pillow blocks that are further mounted to the limbs. Where an axle assembly or its components are described herein as being joined with or in some orientation relative to an arm, a limb and/or limb portion, that arm, limb and/or limb portion can be any portion of any type of a limb, limb arm or portion, pillow blocks and/or other mounting structures associated with the arm, limb and/or limb portion. The limb 93 can define a limb recess 94. As used herein a limb recess can be formed by a solid limb, between free ends or arms of the solid limb, and/or between separate arms or mini-limbs of a split limb.

The cam 30 can be rotatably mounted to the limb 93 via the axle 40. Optionally, the axle assembly can include a first bearing 50 comprising a first inner portion 51 and a first outer portion 52. The first outer portion 52 can be non-rotatably engaged with the cam 30. The first inner portion 51 can be mounted immediately adjacent the axle 40, and optionally non-rotatable relative to the axle 40. Between the inner portion and the outer portion, ball bearings, pins, rollers or the like can be disposed so that the outer portion 52 rotates freely relative to the inner portion 51.

Further optionally, the axle 40 can include one or more fasteners 40A joined with the axle and operable in a compression mode to thereby compress under a compression force the first inner portion of the first bearing between a first end 41 and the second end 42 of the axle. The first outer portion 52 remains uncompressed when the compression force is applied to the first inner portion 51. As a result, the first outer portion 52 and the cam 30 are rotatable relative to the axle 40, while the first inner portion 51, and any open sided spacers 20, 20A mounted on the axle are non-rotatable relative to the axle 40 under the compression force.

The various other components aligned along the axle, immediately adjacent the axle (other than the cam and the outer portion of any bearings) can be clamped under the compression force, which can be an axial clamping force, between the ends of the axle 40, so they will not rotate upon rotation of the cam under normal circumstances. In this clamped configuration, the components along the axle have zero gaps or tolerances between them individually and the limbs. Indeed, these components can be clampingly forced against one another under a compression force, for example, an axial clamping force of optionally at least 1 pound, further optionally at least 5 pounds, yet further optionally at least 10 pounds, even further optionally at least 20 pounds, still further optionally at least 30 pounds, yet further optionally at least 40 pounds, further optionally at least 50 pounds, yet further optionally at least 100 pounds, still further optionally at least 250 pounds, still even further optionally at least 500 pounds, still further optionally between 1 pound and 500 pounds.

Although the current embodiment is described in connection with a dual cam bow, and in particular a binary cam system, the current embodiment and its features are suited for use with simpler pulley systems, for example, in single cam systems. The axle assembly, limb, cam and other features also can be used in other dual cam, cam and a half, and single cam systems as well. Further, the embodiments herein are well suited for compound archery bows, dual cam bows, cam and a half bows, crossbows and other archery systems including two or more cams. As used herein, a "cam" refers to a cam, a pulley, and/or an eccentric, whether a modular, removable part, or an integral part of a cam assembly, for use with an archery bow. However, when a cam is described as an "eccentric cam," this refers to a cam that rotates about an axis distal from a center of the body, for example a geometric center, and this term excludes perfectly circular pulleys such as those used in single cam archery bows.

As used herein, a "track" refers to a structural element that is adapted to guide or accommodate a portion of a bowstring or power cable within or adjacent the element, and can be in the form of a groove, a recess, a slot, pins or posts extending from or defined by a surface or element. When in the form of a groove or recess, that element can be defined by a part of a cam assembly, for example, defined by a bowstring cam and/or a power cable cam, and can be of virtually any geometric cross section, for example, partially or fully semi-circular, rounded, triangular, rectangular, square, polygonal, or combinations of the foregoing. The cam and/or module can be formed from rigid material, such as a metal, optionally aluminum, titanium, or magnesium, or a non-metal, optionally composites and/or polymers.

As used herein, an "axis of rotation" refers to an axis about which a cam can and/or does rotate, for example, a rotational axis of cam 30. Optionally, the axis of rotation can coincide with the longitudinal axis LA of axle 40 to which the cam is mounted. Although not described in detail, the cam herein can include modular elements that provide some level of adjustment of a performance characteristic of a bow, including but not limited to, a particular draw length, draw stop or draw force for the bow. The assemblies also can include draw stops and other components common to cams as desired.

Figure 2:
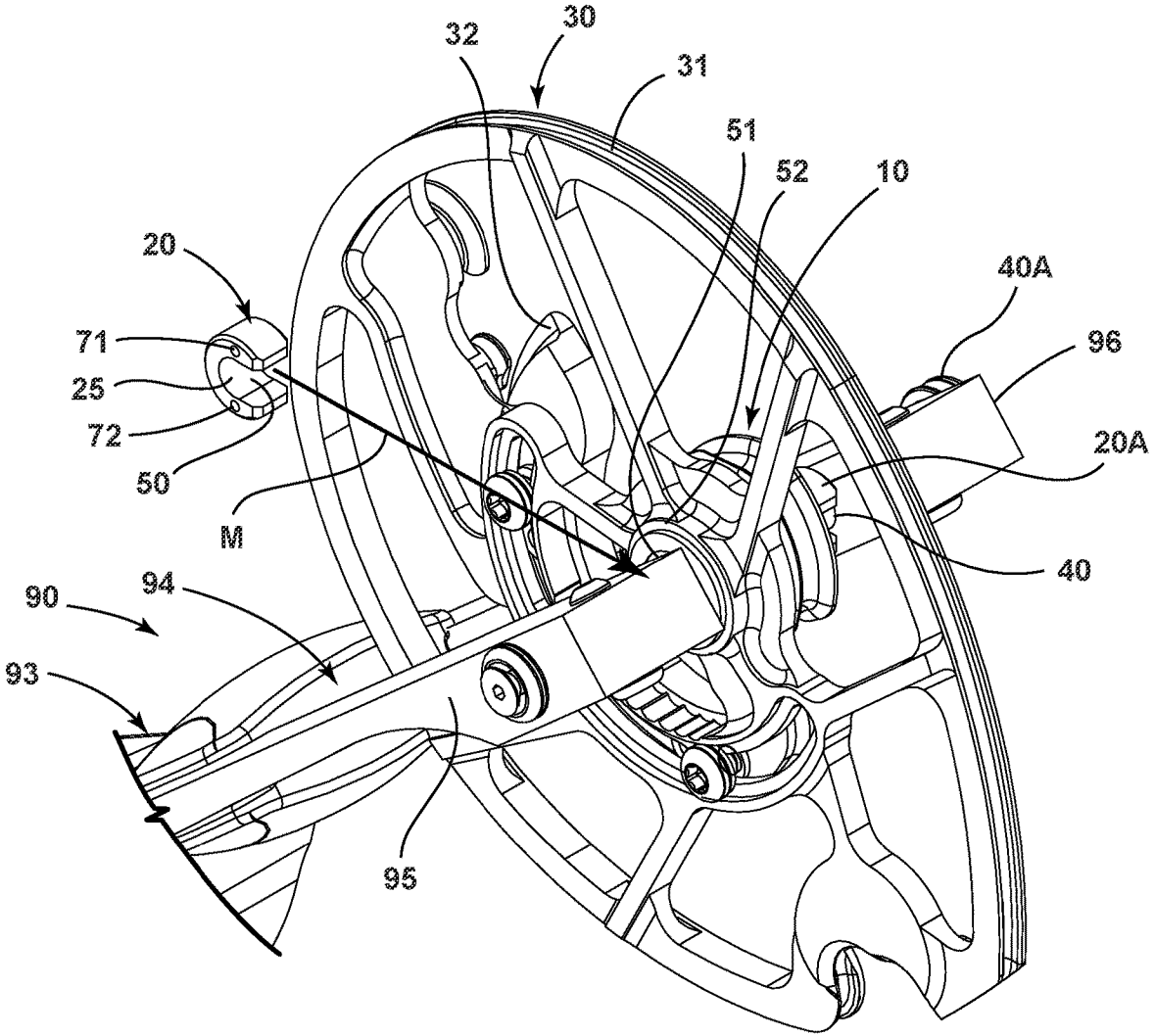
FIG. 2 is a close up perspective view of the axle assembly and cam with one open sided spacer installed and another about to be installed on an axle.
Figure 3:
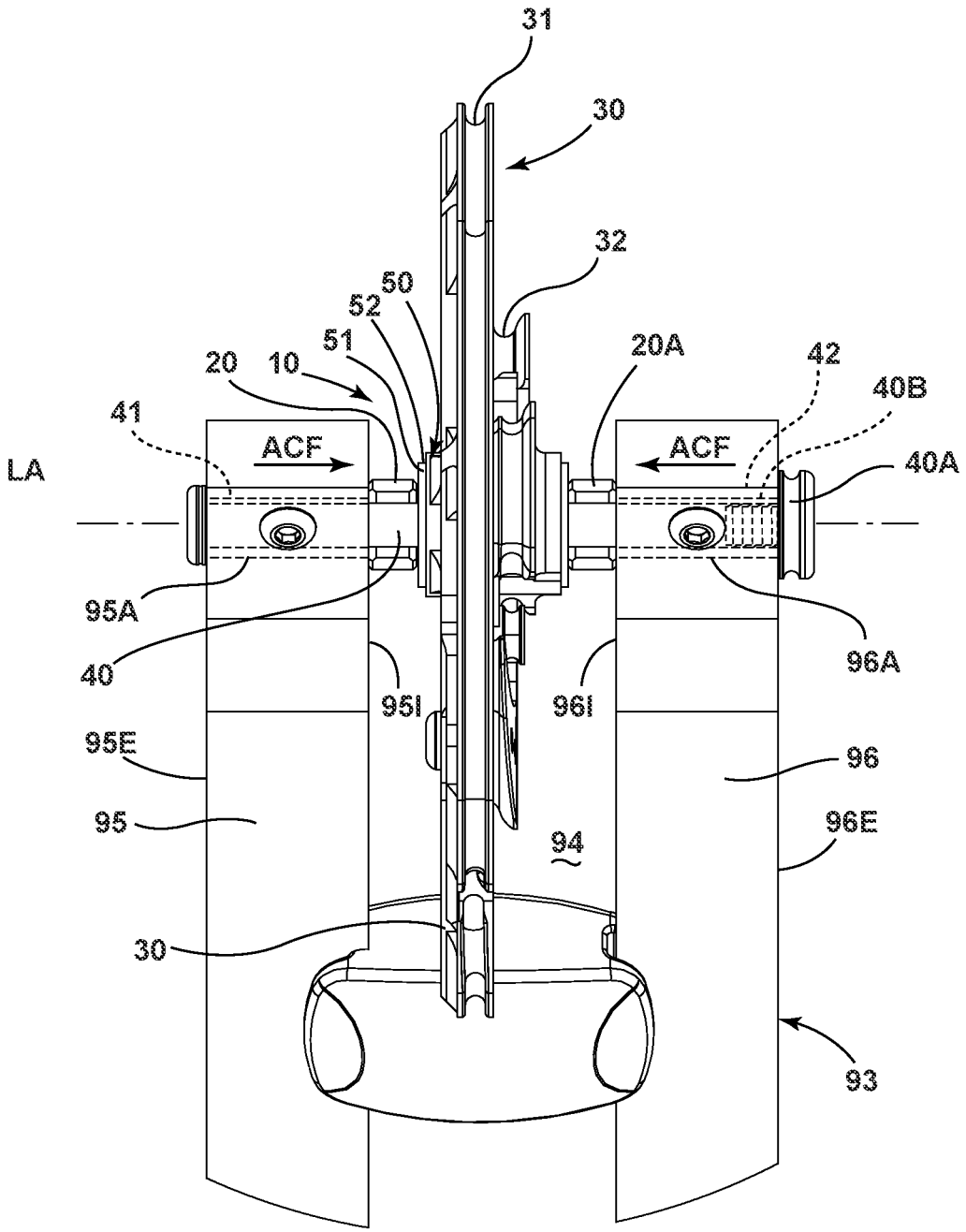
FIG. 3 is a close up rear view of the open sided spacers fully installed on the axle and aligning the cam.

The cam 30 as mentioned above is rotatably mounted on the limb 93 which can include a first arm 95 and second arm 96. As shown in FIGS. 2-3, the axle 40 can project at least partially through a first aperture 95A defined by the first arm, which can be part of a split limb, a first portion of a solid limb and/or a pillow block, and through a second aperture 96A defined by the second arm which can be part of a split limb, a first portion of a solid limb and/or a pillow block. The cam 30 can be adapted to rotate about its axis of rotation, which coincides with the longitudinal axis LA of the axle 40.

The limb 93, that is, each of the sub limbs or other portions of a solid limb, or pillow blocks, can include an interior surface. For example, the first limb arm 95 can include an interior surface 951 and an exterior surface 95E. The other limb arm 96 can include an interior surface 951 and an exterior surface 95E. The interior surfaces of the limb portion can face toward the cam 30 and can directly engage the open face spacers 20, 20A as described below, while the exterior surfaces can face away from these elements. The interior surfaces, as described in further detail below also can contact and be clamped against under a compression force, one or more components that are disposed along the axle between the limb arms within the recess 94.

The axle as mentioned above can include first fastener 40A that is joined with the axle 40 at an axle end 42. Although shown as a single fastener, two fasteners can be used with the axle, installed at opposite ends thereof. In some cases, the axle 40 itself can be in the form of a large bolt or fastener (not shown) with a head disposed on the exterior surface 96E of one limb arm, and a nut (not shown) attached to threads that protrude from the exterior surface 95E of the other limb arm.

The axle in FIG. 3 can include a threaded bore 40B. The fastener 40A can be threaded into the bore 40B. When tightened, the fastener 40A can exert an axial clamping force ACF in the direction of the arrows. This axial clamping force ACF can be a compression force against all components that are disposed along the axle between the first end 41 and the second end 42 of the axle 40. These respective components, can be in direct engagement with one another. To the extent that other components, such as the outer portions of any bearings and the cam 30 are not engaged by other components under the axial compression force ACF, those components can be free to rotate about the axle 40.

When exerted, the axial clamping force ACF can be optionally at least 1 pound, at least 5 pounds, at least 10 pounds, at least 20 pounds, at least 30 pounds, at least 40 pounds, at least 50 pounds, at least 100 pounds, at least 250 pounds, at least 500 pounds, or between 1 pound and 500 pounds. The axial clamp force ACF can be significant enough that the components along the axle forcibly engage against one another so that rotation of those components clamped against one another is impaired and/or prevented. For example, to rotate one component relative to the next adjacent component, against which it is clampingly and forcibly compressed, one of the components will have exerted upon it a torque of optionally at least 1 inch pound, at least 5 inch pounds, at least 10 inch pounds, at least 15 inch pounds, at least 20 inch pounds, or between 1 inch pound and 100 inch pounds. In some cases, the axial clamping force ACF can not only set the gap or tolerance between components along the axle that are abutted against one another to 0.00 inches, but in addition, the axial clamping force ACF can press those components against one another forcefully enough under a compression or clamping force that the components do not rotate relative to one another along the axle without exertion of significant torque.

As shown in FIG. 3, when the axle 40 is assembled, the various components disposed between the limbs, optionally can be under a compression force, for example, the axial clamping force ACF described above. Under the axial clamping force ACF, the various components are pressed together and engage one another so that there optionally is zero gap or tolerance between each of the components. Further, these components, effectively can be clamped against one another and forcefully engage one another under that axial clamping force.

The open sided spacer 20 will be described in more detail with reference to FIGS. 2-7. The open sided spacer generally is removable without pulling or removing the axle 40 from the limb 93. In particular, the axle 40 can remain in engagement with the limb arms 95 and 96, such that the ends 41 and 42 remain associated with, joined with or contacting those limb arms. The axle is not withdrawn from the limb, so that it continues to extend within or across the limb recess 94, while installing, manipulating, servicing or removing the spacer 20.

The spacer 20 can include one or more friction elements 23 as described below that frictionally engage the spacer 20 as it is pressed or urged on and off the axle 40 during installation and/or removal. The spacer can be mounted on an axle 40 under compression force ACF, and installed or removed by loosening the fastener 40A to remove the compression force. Thereafter, a user can use a tool, such as a hammer or wrench to bump or nudge the open sided spacer 20 on or off the axle in a direction that is transverse to, rather than parallel to or aligned with, the longitudinal axis LA of the axle as described below. The spacers 20, 20A can be provided in a set, and can have similar or varying thicknesses. These same or varied thicknesses of the spacers can shift the cam 30 left and right along the axle 40 to modify, adjust and/or maximize the center shot or tune of the archery bow 90.

Figure 4:
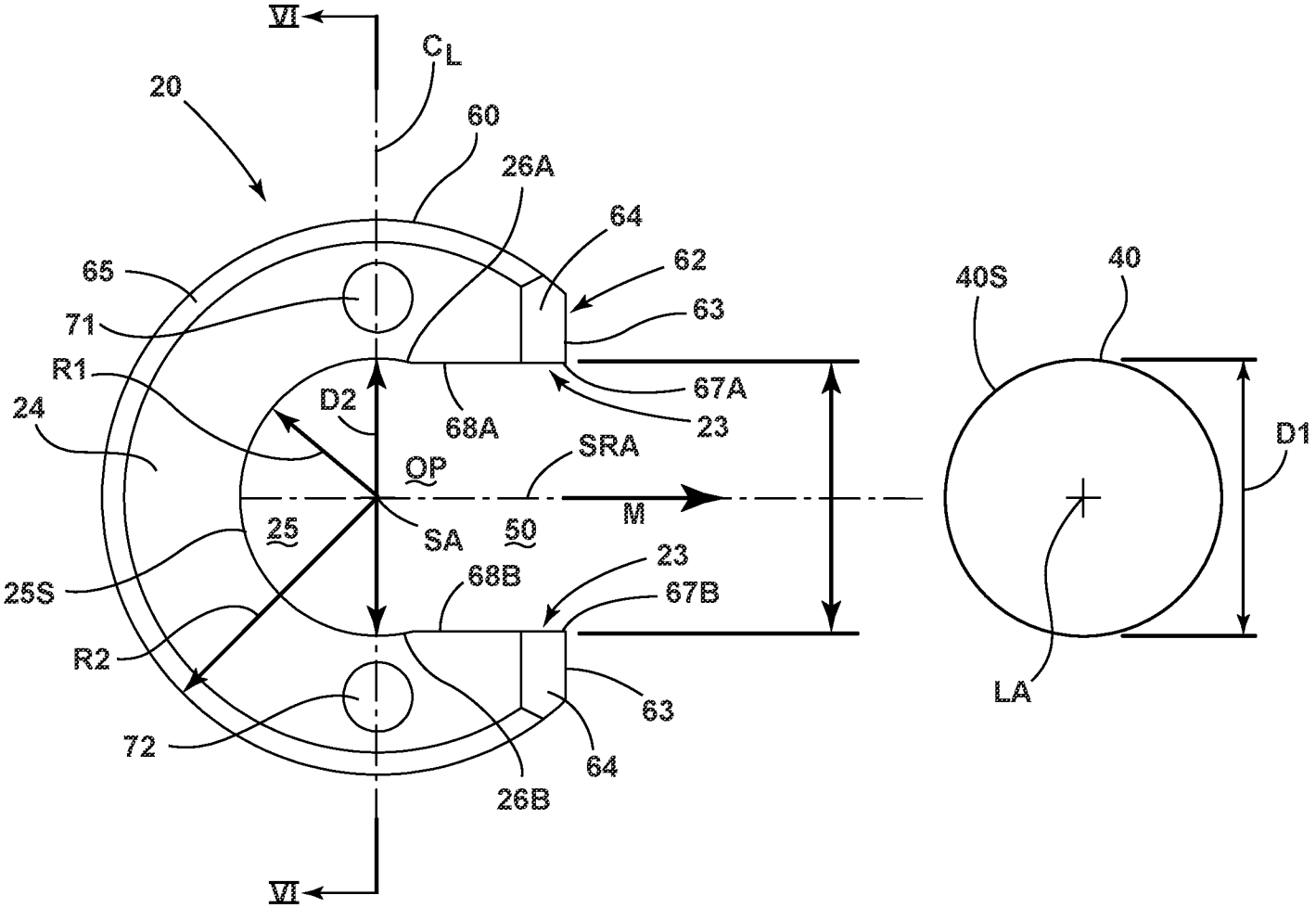
FIG. 4 is a side view of the open sided spacer and the axle.
Figure 5:
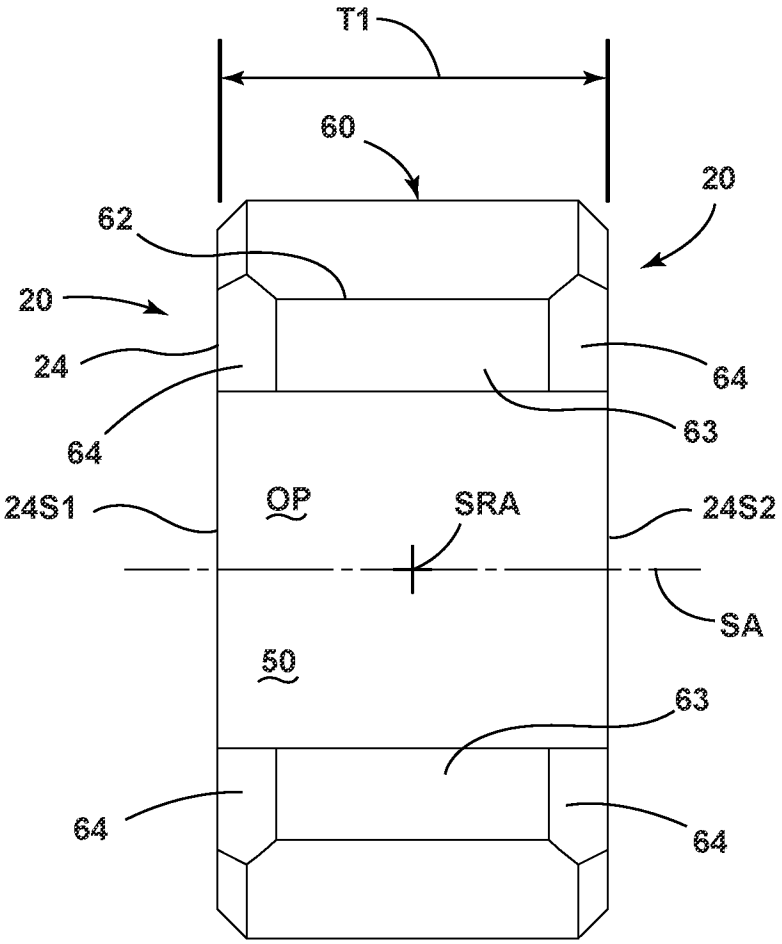
FIG. 5 is a front view of the open sided spacer.
Figure 6:
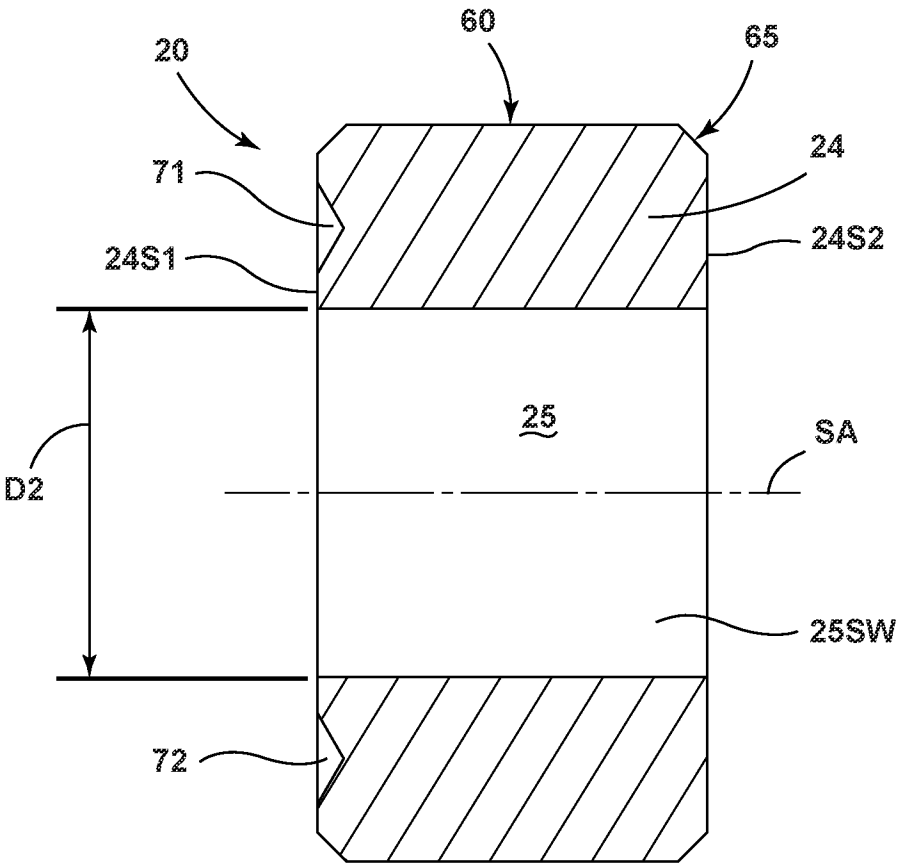
FIG. 6 is a section view of the open sided spacer taken along line VI-VI in FIG. 4.
Figure 7:
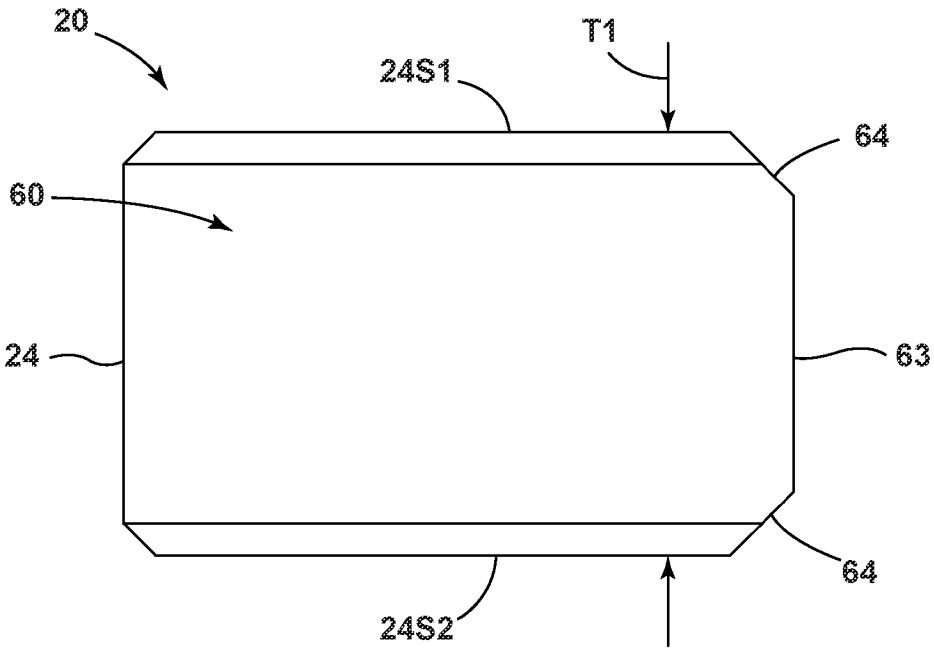
FIG. 7 is a top view of the open sided spacer with a first thickness.

With reference to FIGS. 4-6, the open sided spacer 20 can include a body 24 defining a longitudinal axis SA and axle aperture 25 that can be generally centered on the longitudinal axis SA. The axle aperture 25 can be configured to receive the axle 40 therein. The axle aperture can include a diameter D2 that is slightly greater than or equal to the diameter D1 of the axle 40 as shown in FIG. 4. The diameter D2 optionally can be about 0.25 inches, between about 0.10 inches and about 0.50 inches, between about 0.20 and about 0.40 inches, or other diameters depending on the size of the axle 40. The diameter D1 can be equal to or less than the diameter D2 such that the axle 40 can fit within and/or through the axle aperture 25, which can include a longitudinal axis SA.

When fully installed, the longitudinal axis SA of the axle aperture 25 can be aligned with the longitudinal axis LA of the axle 40. The axle aperture can include a radius around at least half of the aperture. The axle aperture 25 optionally can include a centerline CL. As shown in FIG. 4, to the left of the centerline CL, the aperture 25 can include a constant radius R1 extending to sidewall 25S of the axle aperture 25. The sidewall 25S can be partially or fully cylindrical, opening to the spacer recess 50 and extending outward to the outer perimeter 60 of the spacer body 20.

In particular, the spacer body 24 of the open sided spacer 20 can include an outer perimeter 60. This perimeter can extend around the outer periphery of the spacer body and can be interrupted by a spacer recess 50 that extends inwardly toward the longitudinal axis SA and toward the axle aperture 25 so the spacer recess and axle aperture form a continuous opening OP. With this continuous opening extending inwardly from the outer perimeter 60, the spacer body 24 optionally can take on a generally C-shape, U-shape or E-shape.

The outer perimeter 60 shown in FIG. 4 can extend about the longitudinal axis SA at a constant radius R2 to the left of the centerline CL. To the right of the centerline CL, the outer perimeter 60 can extend to an outer shoulder 62 at which the radius R2 stops. At the shoulder 62, the outer perimeter can transition to a face 63 which optionally can be bounded by chamfered, rounded or angled faces 64 on opposite sides of a spacer recess axis SRA that extends perpendicular or orthogonal to the longitudinal axis SA of the spacer body 24. Optionally, another chamfered, rounded or angled face 65 can extend around the perimeter on opposing lateral surfaces 24S1 and 24S2 of the spacer body 24. Although shown as angled or chamfered surfaces, the various surfaces and shoulder described above can be rounded to include radii, depending on the application.

The forward surfaces 63 above and below the spacer recess axis SRA can transition to engagement edges 67A and 67B. The engagement edges can be the portion of the spacer body 24 that first engage the axle 40 in particular its exterior side wall 40S, which optionally can be cylindrical. The edges 67A and 67B can form a corner with the respective recess sidewall 68A and 68B that extend inwardly and generally toward the centerline CL of the spacer body 24. The surfaces 63 and respective sidewalls 68A and 68B can optionally form right angles at the respective corners where they transition to one another. These right angles can include a small slightly radiused portion depending on the manufacturing techniques for forming the open sided spacer 20.

The open sided spacer optionally can be constructed from a variety of materials, such as metal, composites, polymer and or combinations thereof. The open sided spacer can be molded, machined, 3D printed or formed in a variety of other suitable manners. Optionally, the spacer body 20 can be constructed such that the spacer recess width D3 can be slightly increased when the spacer body 24 engages the axle 40 as described below.

Returning to FIGS. 4-6, the open sided spacer 20 can include the sidewalls 68A and 68B that extend inwardly toward the sidewall 25S of the axle aperture 25. The spacer recess sidewalls 68A and 68B can transition to the axle aperture sidewall 25S at respective shoulders 26A and 26B. The shoulders can transition from the rounded or cylindrical axle aperture sidewall 25S to the flat planar recess sidewalls 68A and 68B. The shoulders 26A and 26B can form subtle ridges at the inward end of the spacer recess 50. The shoulders 26A and 26B can be disposed sufficiently past the centerline CL so as to trap the axle 40 in the axle aperture 25 when the axle 40 is installed in the axle aperture 25 and the longitudinal axis LA of the axle 40 is generally aligned with the longitudinal axis SA of the spacer body 24. The shoulders 26A and 26B can be disposed at a distance D3 from one another that is less than the diameter D2 of the axle aperture and less than the diameter D1 of the axle 40.

Sometimes, when the shoulders are included, they can operate to lock the axle 40 in the axle aperture. Optionally, when the axle 40 is installed into the opening OP by moving the spacer 20 toward the axle 40 in direction M, the axle sidewall 40S slides along the respective sidewalls 68A and 68B of the recess 50. As this occurs, the axle frictionally engages these sidewalls due to the axle 40 having a diameter D1 that is greater than the recess width D3. In some cases, the recess width D3 can actually increase, with the edges 67A and 67B moving away from one another as the axle 40 enters the spacer recess 50, generally moving along the spacer recess axis toward the longitudinal axis SA of the axle aperture 25. Due to this friction fit, the sidewalls 68A and 68B also or alternatively can be urged away from one another slightly, as the axle 40 moves through the continuous opening OP. Eventually, when the axle 40 passes the shoulders 26A and 26B, and enters into the axle aperture 25, the sidewalls 68A and 68B can move back toward one another and the width of the recess D3 can return to its static condition.

As mentioned above, the spacer body 24 can include lateral surfaces 24S1 and 24S2. These surfaces can be separated by thickness T1. This thickness T1 can be optionally between about 0.005 inches and about 0.500 inches, between about 0.050 inches and about 0.400 inches, between about 0.050 inches and about 0.300 inches, between about 0.100 and about 0.275 inches, between about 0.250 inches and 0.27 inches, about 0.100 inches, about 0.130 inches or about 0.160 inches or other dimensions depending on the application and suitable spacing for the cam 30 along the axle, between the respective limb arms 95 and 96.

Figure 9:
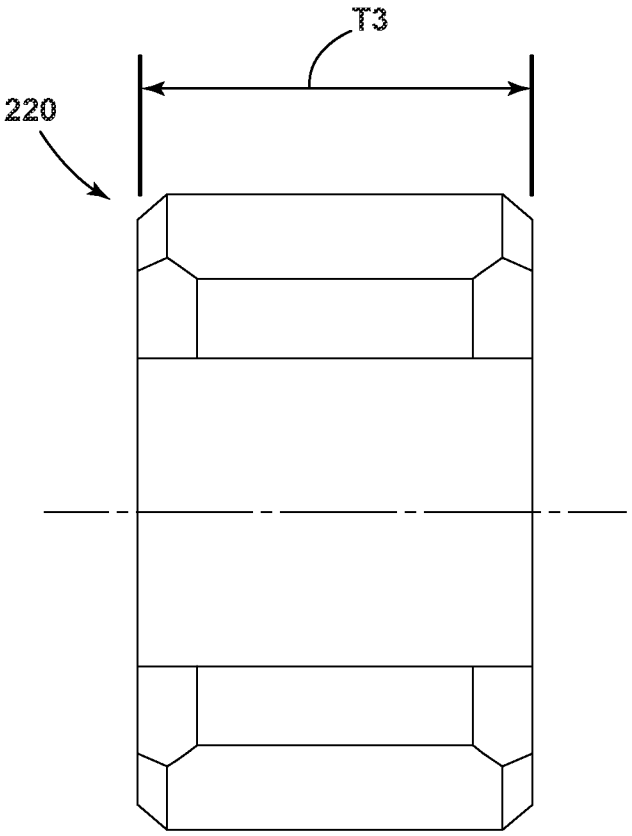
FIG. 9 is a front view of another alternative open sided spacer with a third thickness.
Figure 8:
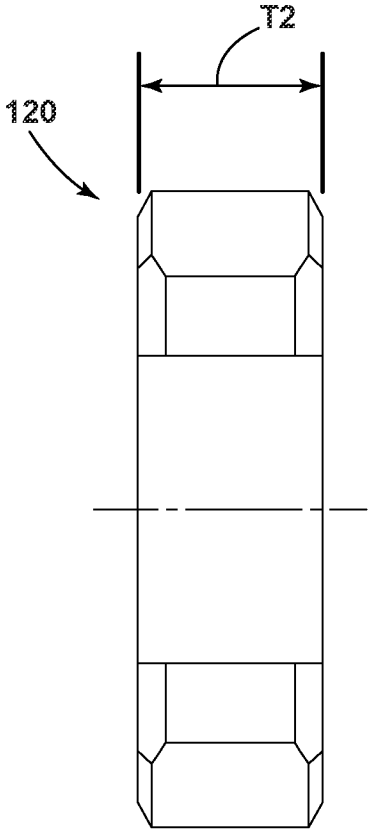
FIG. 8 is a front view of an alternative open sided spacer with a second thickness.

Optionally, the open sided spacer herein can be provided with varying thicknesses. For example, as shown in FIG. 8, an alternative embodiment of the spacer 120 can include a second thickness T2, with all the other components and structures of the spacer 120 being similar or identical to the spacer 20. As shown in FIG. 9, yet another alternative embodiment of the spacer 220 can include a third thickness T3, with all the other components and structures of the spacer 220 being similar or identical to the spacer 20. The second thickness T2 of the second spacer 120 can be less than the thickness T1 of the first spacer 20. The third thickness T3 of the third spacer 220 can be greater than the thickness T1 of the first spacer 20. Further optionally, a variety of spacers 20, 120 and 220 can be provided in a set and offered to consumers. There may be multiple ones of each of the spacers 20, 120 and 220 in the set. The spacers of varying thicknesses can be mixed and matched, and installed on the axle to precisely position the cam 30 along the axle 40, between the first axle end 41 and second axle end 42, to provide suitable tuning and center shot placement for the cam.

As shown in FIGS. 4 and 6, the open sided spacer 20 optionally can include indicia elements 71, 72. These indicia elements can represent the overall thickness T1 of the spacer body 24. These indicia elements 71, 72 as shown can be in the form of recesses defined in surfaces 24S1 or 24S2 of the spacer body 24. These recesses can be drilled or machined into those surfaces. Optionally, in some cases, the indicia elements can be in the form of projections that extend outward from one or more of the surfaces of the spacer body 24, for example, the outer perimeter 60 other surfaces. These indicia elements also can be of different shapes than the circular shape as shown. For example, they can be triangular shapes, polygonal shapes or alphanumeric characters that are printed on the side surfaces 24S1 or 24S2. In other cases, the characters can be printed on molded or stamped into the outer perimeter 60 so that they can be viewable at all times by a user to facilitate testing of different thickness spacers. Of course, with the alternative spacers 120 and 220, having different thicknesses T2 and T3, those spacers can include indicia elements that are different from the spacer 20 to represent the different thicknesses. In other cases, the spacer bodies can be painted, coded, anodized or otherwise include different colors to represent the different thicknesses T1, T2 and T3 or other thicknesses.

A method of using the archery bow assembly will be described with reference to FIGS. 1-4. In general, the method can include providing an axle 40 installed relative to opposing arms 95, 96 of a limb 93 of an archery bow 90, with a cam 30 rotatably mounted on the axle 40 in a limb recess 94 between the opposing arms and pressing an open sided spacer 20 onto the axle 40 within the limb recess in a direction M transverse to the longitudinal axis LA of the axle 40 such that the axle passes through a spacer recess 50 until the axle 40 enters an axle aperture 25 of the spacer 20. The open side spacer 20 is installed on the axle 40 without removing the axle from the opposing arms of the limb or the limb recess.

More particularly, as shown in FIGS. 2-4, the open side spacer 20 can be installed to adjust, modify or configure the cam 30 at a predetermined location along the axle 40 and in particular its longitudinal axis. This in turn can adjust the center shot or tune of the cam relative to the limbs and the remainder of the bow 90. To install and/or remove a spacer 20, 20A, a user can loosen the fastener 48 relative to the axle 40. If there is another fastener on the opposing side of the axle, that fastener (not shown) also can be loosened. As a result, the axial compression force ACF on the cam 30 and components between the respective limb arms 95 and 96 can be reduced and/or eliminated.

During installation or removal of an open face spacer, the user can leave the fastener 40A in the bore 40B and thus threaded in the axle 40. The axle likewise can remain installed relative to the limb 93. In particular, the first end 41 and second end 42 of the axle can remain installed in and engaging the respective limb arms 95 and 96. The axle ends 41 and 42 are not removed or pulled through the respective apertures 95A and/or 96A in which the axle is mounted, nor is the axle removed from the recess 94 between the limb arms 95 and 96 to install, remove and/or adjust the open sided limb spacers 20 and 20A. Further, it is noted that these actions can be taken with or without the use of a bow press compressing the limbs of the bow, optionally such that the spacers can be installed, removed and/or modified relative to the axle without the use of a bow press in some applications.

As shown in FIG. 2, after the fastener 40A is loosened to remove the axial compression force ACF between the limb arms 95 and 96 and other components, the open sided spacer can be selected for positioning along the axle 40. In some applications, the user can select it from a set of spacers to properly position the cam in a predetermined location along the axle. For example, a user can select one of the spacers 20, 120, 220 from a set of those spacer bodies. As noted above, the spacers can have different thicknesses T1, T2, T3 or the like. The user can install the spacer having a predetermined thickness on the axle. In some cases, the user can install one spacer having a first thickness on one side of the cam, and another spacer having the same or a different thickness, greater or lesser, than the first thickness on the other side of the cam. In other cases, a user can mix and match spacers on the same side of a cam depending on the application.

As mentioned above, the spacers optionally can include the indicia elements 71, 72 associated with a particular thickness. The user can use these indicia elements to identify a spacer having a particular thickness suitable for the application and installation on the axle.

To install the spacer 20 on the axle 40, the spacer 20 can be moved in direction M toward the axle as shown in FIGS. 2 and 4. This direction M can be transverse and optionally perpendicular to the longitudinal axis LA. The spacer 20 can be engaged against the axle 40 with the edges 67A and 67B initially engaging the exterior surface or wall 40S of the axle 40. The spacer recess axis SRA can be aligned with the longitudinal axis LA of the axle 40. The spacer can be pushed onto and pressed against the axle with a force of optionally at least 1 pound, at least 2 pounds, at least 3 pounds, at least 4 pounds, at least 5 pounds, at least 6 pounds, at least 7 pounds, at least 8 pounds, at least 9 pounds, at least 10 pounds, at least 20 pounds, at least 30 pounds, at least 40 pounds or other forces depending on the application. With this force, the distance D3 between the side walls 68A and 68B can increase slightly to accommodate the diameter D1 of the axle 40. The axle side wall 40S can frictionally slide along the recess side wall 68A and 68B until passing the shoulders 26A and 26B and entering the axle aperture 25 as described above. Optionally, the spacer and/or axle can make an audible snap when entering the axle, which indicates that the spacer is fully installed on the axle 40.

The spacer 20 can be installed along the axle within the limb recess 94. The spacer 20 can be positioned so that the spacer body 24 is mounted between the cam 30 and the limb arm 95, or the limb arm 96 so the spacer is in the location of the other spacer 20A as shown in FIGS. 2 and 3. The spacer 20 can be installed so that its lateral surfaces 24S1 and 24S2 are disposed between the cam 30, and any optional bearing 50, as well as between the interior surfaces 951 or 961 of the limb 93. The spacer body optionally is not placed along the axle 40 adjacent the exterior surfaces 95B or 96B of the limb 93.

Where the bearing 50 is included, the spacer body 20 can be placed adjacent the first inner portion 51 of the bearing, and distal from the first outer portion 52 of the bearing. The second lateral surface 24S2 can directly contact the first inner portion 51 of the bearing. The first lateral surface 24S1 can directly contact the interior surface 951 of the limb arm 95. Generally, the second lateral surface can face away from the cam 30 and the first lateral surface can face toward the cam.

The process mentioned above for installing the open sided spacer 20 can be repeated for another spacer 20A, or the alternative spacers 120, 220 or additional spacers along the axle within the recess 94. Again spacers of the same width or of different widths can be mixed and matched for installation on the axle depending on the application.

With the spacers installed, and in cases where the archery bow assembly 10 utilizes a compression system, an axial compression force ACF can be applied to the assembly 10. To do so, a user can rotate the fastener 40A relative to the axle 40 thereby providing the axial compression force ACF. This in turn exerts the compression force on the open sided spacers 20, 20A, as well as the inner portions of the bearings and optionally the cam 30 located between the arms 95 and 96. The compression force can be any of the compression forces mentioned above, for example, between 1 pound and 500 pounds.

The first outer portion, 52, however, can remain uncompressed, unclamped, and not under the axial clamping force ACF when that axial clamping force is applied to the first inner portion. As a result, the first outer portion 52 of the bearing and the cam 30 are free to rotate relative to the axle 40, while the first inner portion 51 can remain nonrotating relative to the axle 40 and the spacer 20 under the axial clamping force ACF.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to," another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An archery bow assembly comprising:

a limb defining a limb recess;

an axle joined with the limb, the axle including a first axle end and a second axle end distal from one another;

a cam rotatably mounted relative to the axle within the limb recess, the cam including a bowstring track;

an open sided spacer including a body defining a longitudinal axis and an axle aperture that surrounds the longitudinal axis, the axle aperture receiving the axle between the first axle end and the second axle end, the body including an outer perimeter interrupted by a spacer recess that extends inwardly toward the longitudinal axis and the axle aperture so that the spacer recess and axle aperture form a continuous opening, the open sided spacer joined with the axle in the limb recess adjacent the cam, distal from the first axle end and from the second axle end;

wherein the open sided spacer is mountable to the axle and removable therefrom without removing the axle from the limb.

2. The archery bow assembly of claim 1, comprising:

a first bearing comprising a first inner portion and a first outer portion, the first outer portion non-rotatably engaged with the cam, wherein the open sided spacer is engaged with the first inner portion, but not the first outer portion.

3. The archery bow assembly of claim 1, wherein the first axle end is joined with a first arm of the limb, wherein the second axle end is joined with a second arm of the limb, wherein the open sided spacer body is removable from the axle completely while leaving the first axle end joined with the first arm of the limb and the second axle end joined with the second arm of the limb.

4. The archery bow assembly of claim 1, comprising:

a bearing mounted to the cam adjacent the open sided spacer; and a fastener joined with the axle and operable in a compression mode to thereby compress under a compression force the open sided spacer against the bearing with the cam remaining rotatable relative to the axle.

5. The archery bow assembly of claim 1, wherein the axle includes an axle diameter, wherein the spacer recess includes a spacer recess width, wherein the spacer recess width is less than the axle diameter so that when the body is installed relative to the axle, the axle engages opposing sidewalls of the spacer recess with friction.

6. The archery bow assembly of claim 5, wherein the axle aperture includes an axle aperture diameter, wherein the axle aperture diameter is greater than the axle diameter, wherein the spacer recess width is less than the axle aperture diameter.

7. The archery bow assembly of claim 1, wherein the axle aperture defines and axle aperture axis, wherein the body includes a first recess sidewall and an opposing second recess sidewall that extend inwardly from the outer perimeter and bound the spacer recess, wherein the spacer recess includes a spacer recess axis, wherein the spacer recess axis is perpendicular to the axle aperture recess, wherein the first recess sidewall and the second recess sidewall are parallel to one another and to the spacer recess axis, wherein the body includes a thickness between about 0.050 inches and about 0.300 inches.

8. The archery bow assembly of claim 1, wherein the limb recess is bounded by opposing limb arms to which the first axle and second axle end are joined, wherein the open sided spacer is clamped via a compressive force between the opposing limb arms.

9. The archery bow assembly of claim 1, wherein the body includes a thickness extending between a first surface and a second surface, wherein the first surface is configured to face the cam, wherein the second surface is configured to face away from the cam, wherein the body includes an indicia element on at least one of the first surface and the second surface that indicates the thickness, whereby a user can visually view the indicia element and correlate that to the thickness.

10. An archery bow assembly comprising:

a spacer body defining a longitudinal axis and including a thickness between about 0.050 inches and about 0.300 inches, the spacer body defining an axle aperture that surrounds the longitudinal axis and is configured to receive an axle of an archery bow upon which a cam rotatably mounts;

an outer perimeter extending around the spacer body, the outer perimeter interrupted by a spacer recess that extends inwardly toward the longitudinal axis and the axle aperture so that the recess and axle aperture form a continuous opening, wherein the spacer body is mounted to the axle of the archery bow within a limb recess, and removable from the axle without removing the axle from a limb of the archery bow.

11. The archery bow assembly of claim 10, wherein the axle is joined with the limb and extends between a first axle end and a second axle end, wherein the spacer body is distal from the first axle end and the second axle;

wherein a cam is rotatably mounted on the axle, the cam including a bowstring track, wherein the spacer body is mounted between the cam and a limb arm of the limb in the limb recess.

12. The archery bow assembly of claim 10, comprising:

a first bearing comprising a first inner portion and a first outer portion; and a fastener joined with the axle and operable in a compression mode to thereby compress under a compression force the first inner portion against the spacer body, wherein the first outer portion remains uncompressed when the compression force is applied.

13. The archery bow assembly of claim 10, wherein the axle includes an axle diameter, wherein the spacer recess includes a spacer recess width, wherein the spacer recess width is less than the axle diameter so that when the spacer body is installed relative to the axle, within the limb recess, the axle engages opposing sidewalls of the spacer recess with friction.

14. The archery bow assembly of claim 13, wherein the spacer body includes a spacer recess sidewall that transitions to an axle aperture sidewall at a shoulder, wherein the shoulder confines the axle to the axle aperture.

15. A method of using an archery bow assembly, the method comprising:

providing an axle installed relative to opposing arms of a limb of an archery bow, with a cam rotatably mounted on the axle in a limb recess between the opposing arms, the axle including a longitudinal axis; and pressing an open sided spacer onto the axle within the limb recess in a direction transverse to the longitudinal axis of the axle such that the axle passes through a spacer recess until the axle enters an axle aperture of the spacer, wherein the open sider spacer is installed on the axle without removing the axle from the opposing arms of the limb.

16. The method of claim 15, comprising:

exerting a compression force on the open sided spacer of between 1 pound and 500 pounds.

17. The method of claim 16 comprising:

rotating a fastener relative to the axle to exert the compression force on the open sided spacer and an inner portion of a bearing engaged with the open sided spacer so that an outer portion of the bearing is rotatable with the cam about the longitudinal axis of the axle.

18. The method of claim 15 comprising:

sliding the axle through the spacer recess such that a width of the spacer recess increases as the axle moves through the spacer recess, then decreases after the axle settles in the axle aperture.

19. The method of claim 15 comprising:

spacing the cam in a predetermined location along the axle in the limb recess between the opposing arms with the spacer body, wherein a first thickness, between about 0.050 and 0.300 inches, of the spacer body separates the cam from one of the opposing arms.

20. The method of claim 19, comprising:

installing another spacer body between the cam and another one of the opposing arms, the other spacer body having a second thickness different from the first thickness.

* * * * *